US012297821B2

(12) United States Patent
Noh et al.

(10) Patent No.: US 12,297,821 B2
(45) Date of Patent: May 13, 2025

(54) LINEAR COMPRESSOR

(71) Applicant: LG ELECTRONICS INC., Seoul (KR)

(72) Inventors: Kiwon Noh, Seoul (KR); Donghyeok Kwon, Seoul (KR); Sungchul Gong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 17/875,852

(22) Filed: Jul. 28, 2022

(65) Prior Publication Data

US 2023/0175497 A1 Jun. 8, 2023

(30) Foreign Application Priority Data

Dec. 6, 2021 (KR) ..... 10-2021-0172818

(51) Int. Cl.

| | |
|---|---|
| ***F04B 39/14*** | (2006.01) |
| ***F04B 35/04*** | (2006.01) |
| ***F04B 39/06*** | (2006.01) |
| ***F04B 39/12*** | (2006.01) |

(52) U.S. Cl.

CPC ..... *F04B 39/123* (2013.01); *F04B 35/045* (2013.01); *F04B 39/06* (2013.01); *F04B 39/121* (2013.01); *F04B 39/14* (2013.01)

(58) Field of Classification Search

CPC .... F04B 35/045; F04B 17/04; F04B 39/0005; F04B 39/122; F04B 39/123; F04B 39/12; F04B 53/16; F04B 53/166; F04B 39/064; F04B 39/06; F04B 39/14; F04B 39/121; F04B 39/125; F04B 39/126; F04B 39/127; F04B 35/04; F05B 2210/14; F05B 2260/30

See application file for complete search history.

(56) References Cited

U.S. PATENT DOCUMENTS

| | | | | |
|---|---|---|---|---|
| 2006/0093495 | A1* | 5/2006 | Oh | H02K 1/185 417/415 |
| 2018/0195504 | A1* | 7/2018 | Lee | F04B 39/125 |
| 2018/0223822 | A1* | 8/2018 | Lee | F04B 53/128 |
| 2018/0372082 | A1* | 12/2018 | Kim | F04B 35/04 |
| 2019/0234391 | A1* | 8/2019 | Noh | F04B 39/12 |
| 2020/0003198 | A1* | 1/2020 | Noh | F04B 39/0061 |
| 2020/0003201 | A1* | 1/2020 | Noh | F04B 35/045 |

FOREIGN PATENT DOCUMENTS

| | | | |
|---|---|---|---|
| KR | 100320209 | B1 * | 1/2002 |
| KR | 10-2002-0068903 | | 8/2002 |
| KR | 20030065836 | | 8/2003 |
| KR | 10-2021-0090009 | | 7/2021 |

OTHER PUBLICATIONS

Office Action in Korean Appln. No. 10-2021-0172818, mailed on Mar. 27, 2023, 8 pages(with English translation).

* cited by examiner

*Primary Examiner* — Dominick L Plakkoottam

(74) *Attorney, Agent, or Firm* — Fish & Richardson P.C.

(57) ABSTRACT

A linear compressor is provided. The linear compressor includes a shell, a frame disposed in the shell, the frame including a body portion and a first flange portion extending radially from a front of the body portion, a cylinder fixed to the body portion, and a piston disposed in the cylinder and configured to reciprocate axially. The first flange portion includes a hole penetrating a front surface and an inner surface of the first flange portion.

13 Claims, 14 Drawing Sheets

FIG. 16 - Prior Art
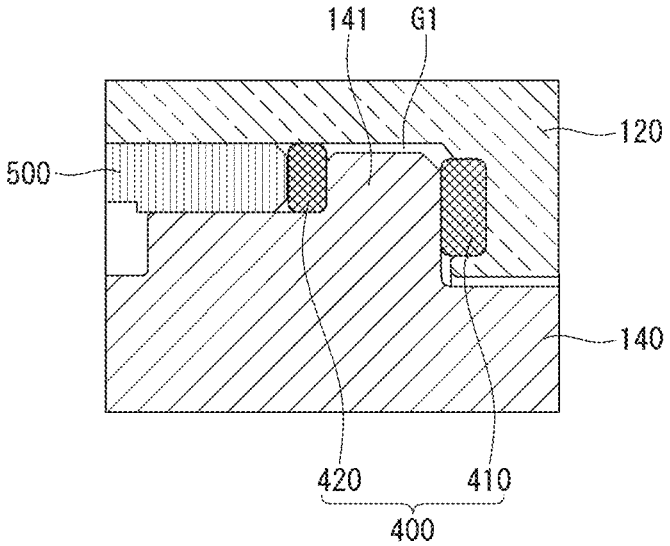
FIG. 17 - Prior Art
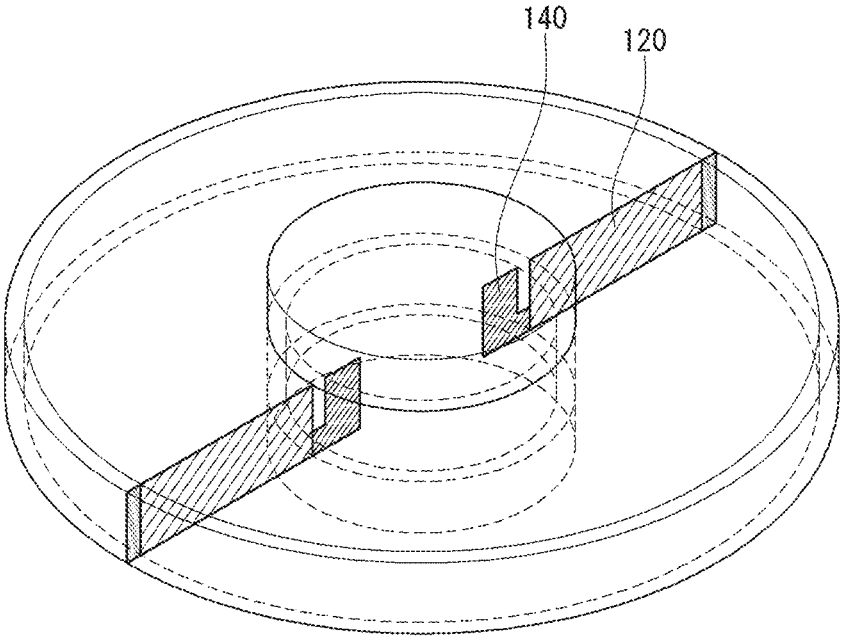

LINEAR COMPRESSOR

CROSS-REFERENCE TO RELATED APPLICATION

This application claims the benefit of Korea Patent Application No. 10-2021-0172818, filed on Dec. 6, 2021, which is incorporated herein by reference for all purposes as if fully set forth herein.

TECHNICAL FIELD

The present disclosure relates to a compressor. More specifically, the present disclosure relates to a linear compressor for compressing a refrigerant by a linear reciprocating motion of a piston.

BACKGROUND

In general, a compressor refers to a device that is configured to receive power from a power generator such as a motor or a turbine and compress a working fluid such as air or a refrigerant. More specifically, the compressors are widely used in the whole industry or home appliances, especially a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates inside the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit are installed inside the linear compressor. The compression unit performs a process of compressing and discharging a refrigerant while performing a resonant motion by a resonant spring through a movement generated in the drive unit.

The piston of the linear compressor repeatedly performs a series of processes of sucking the refrigerant into the casing through a suction pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method.

The oil lubricated linear compressor is configured to store a predetermined amount of oil in the casing and lubricate between the cylinder and the piston using the oil.

On the other hand, the gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through a suction flow path of the piston is sucked into the compression chamber of the cylinder and is heated, and thus can prevent in advance a suction loss from occurring.

However, when the refrigerant and an oil discharged to a refrigeration cycle device are not smoothly returned to the compressor, the oil lubricated linear compressor may experience an oil shortage inside the casing of the compressor. The oil shortage inside the casing may lead to a reduction in the reliability of the compressor.

On the other hand, because the gas lubricated linear compressor can be made smaller than the oil lubricated linear compressor and lubricate between the cylinder and the piston using the refrigerant, the gas lubricated linear compressor has an advantage in that there is no reduction in the reliability of the compressor due to the oil shortage.

FIG. 16 is a cross-sectional view of a partial configuration of a linear compressor according to related art. FIG. 17 schematically illustrates a temperature distribution of a cylinder and a frame of a linear compressor according to related art.

Referring to FIG. 16, in a linear compressor according to related art, a cylinder 140 is disposed inside a frame 120, and a fixing member 500 is disposed on a front surface of a second flange portion 141 of the cylinder 140 to fix the cylinder 140 to the frame 120. An elastic member 400 such as an O-ring may be disposed between the front surface of the second flange portion 141 of the cylinder 140 and the fixing member 500 and between a rear surface of the second flange portion 141 of the cylinder 140 and the frame 120. In this case, the second flange portion 141 of the cylinder 140 and the frame 120 do not completely contact each other due to a tolerance of the product, etc., and an air layer G1 may be formed between the second flange portion 141 of the cylinder 140 and the frame 120.

Referring to FIG. 17, there was a problem in that heat in a front area of the cylinder 140 is not well transferred to the frame 120 due to the air layer G1 formed between the cylinder 140 and the frame 120, and thus the cylinder 140 is maintained in a high temperature state. In this case, there was a problem in that a temperature of a refrigerant sucked into the cylinder 140 increases, and thus compression efficiency is reduced.

SUMMARY

An object of the present disclosure is to provide a linear compressor capable of improving compression efficiency.

Another object of the present disclosure is to provide a linear compressor capable of reducing a temperature of a cylinder.

Another object of the present disclosure is to provide a linear compressor capable of improving a heat dissipation effect of a cylinder as heat transfer by conduction.

Particular implementations of the present disclosure provide a linear compressor including a shell, a frame disposed in the shell, a cylinder fixed to the body, and a piston disposed in the cylinder and configured to reciprocate axially with respect to the cylinder. The frame includes a body and a first flange extending radially from the body. The first flange has first and second surfaces and extends axially between the first and second surfaces. The first flange has an inner surface that defines an inner diameter of the first flange between the first and second surfaces. The first flange includes a hole extending within the first flange and being open at the first surface and the inner surface of the first flange.

In some implementations, the linear compressor can optionally include one or more of the following features. The hole may be in fluid communication with an air layer defined between the inner surface of the first flange and an outer surface of the cylinder. The hole may include a first hole portion extending between the first surface and the inner surface of the first flange, and a second hole portion extending between the inner surface and the second surface of the first flange. The first hole portion and the second hole portion may be connected to each other. The hole may be configured in a 'V'-shape with the first hole portion and the second hole portion corresponding to two straight lines of 'V' respectively. An end of the first hole portion that is open at the first surface of the first flange may be disposed radially further out than an end of the second hole portion that is open at the second surface of the first flange. The hole may include a plurality of holes spaced apart at the first flange in a circumferential direction. The first flange may include a plurality of coupling grooves defined at the first surface of the first flange. The hole may be defined between the plurality of coupling grooves in a circumferential direction. The first flange may include a coupling groove defined at the first surface of the first flange, and a coupling hole spaced apart from the coupling groove in a circumferential direction. The hole may be disposed between the coupling groove and the coupling hole in the circumferential direction. The cylinder may include a second flange protruding radially outward from the cylinder. The first flange may include a flange groove defined at the inner surface of the first flange. The second flange may be positioned at the flange groove of the first flange. The linear compressor may include a first heat transfer member disposed between (i) a surface connecting a bottom surface of the flange groove of the first flange and an inner surface of the frame and (ii) a surface of the second flange. The first heat transfer member may be disposed between (i) the surface connecting the bottom surface of the flange groove and the inner surface of the frame and (ii) the surface of the second flange by introducing the first heat transfer member in a liquid state and curing the introduced first heat transfer member between (i) the surface connecting the bottom surface of the flange groove and the inner surface of the frame and (ii) the surface of the second flange. The linear compressor may include a fixing member disposed between the flange groove of the first flange and an axial end of the cylinder, and a second heat transfer member disposed between the fixing member and a surface of the second flange. The linear compressor may include a third heat transfer member disposed between a bottom surface of the flange groove and an radially-outer surface of the second flange. The hole may be in fluid communication with the third heat transfer member.

Particular implementations of the present disclosure provide a linear compressor including a shell, a frame disposed in the shell, a cylinder fixed to the body, and a piston disposed in the cylinder and configured to reciprocate axially with respect to the cylinder. The frame includes a body and a first flange extending radially from an end of the body. The first flange has first and second surfaces and extends axially between the first and second surfaces. The first flange has an inner surface that defines an inner diameter of the first flange between the first and second surfaces. The first surface is axially closer to the end of the body than the second surface is to the end of the body. The first flange includes a hole extending with the first flange and being open at the second surface and the inner surface of the first flange.

In some implementations, the linear compressor can optionally include one or more of the following features. The hole may be in fluid communication with an air layer defined between the inner surface of the first flange and an outer surface of the cylinder. The cylinder may include a second flange protruding radially outward from the cylinder. The first flange may include a flange groove defined at the inner surface of the first flange. The second flange may be positioned at the flange groove of the first flange. The linear compressor may include a first heat transfer member disposed between (i) a surface connecting a bottom surface of the flange groove of the first flange and an inner surface of the frame and (ii) a surface of the second flange. The first heat transfer member may be disposed between (i) the surface connecting the bottom surface of the flange groove and the inner surface of the frame and (ii) the surface of the second flange by introducing the first heat transfer member in a liquid state and curing the introduced first heat transfer member between (i) the surface connecting the bottom surface of the flange groove and the inner surface of the frame and (ii) the surface of the second flange. The linear compressor may include a fixing member disposed between the flange groove of the first flange and an axial end of the cylinder, a second heat transfer member disposed between the fixing member and a surface of the second flange, and a third heat transfer member disposed between a bottom surface of the flange groove and an radially-outer surface of the second flange.

To achieve the above-described and other objects, in one aspect of the present disclosure, there is provided a linear compressor comprising a shell, a frame disposed in the shell, the frame comprising a body portion and a first flange portion extending radially from a front of the body portion, a cylinder fixed to the body portion, and a piston disposed in the cylinder and configured to reciprocate axially, wherein the first flange portion comprises a hole penetrating a front surface and an inner surface of the first flange portion.

In this case, the hole may communicate with an air layer formed between the inner surface of the first flange portion and an outer surface of the cylinder.

Hence, heat of a front area of the cylinder is transferred to the frame, and thus a temperature of the cylinder can be reduced. Since a temperature of a suction refrigerant introduced into the cylinder can be reduced by reducing the temperature of the cylinder, compression efficiency of the linear compressor can be improved.

The hole may comprise a first hole penetrating the front surface and the inner surface of the first flange portion, and a second hole penetrating the inner surface and a rear surface of the first flange portion.

Hence, a heat transfer efficiency of transferring heat of the front area of the cylinder to the frame can be improved.

The first hole and the second hole may be connected to each other.

The first hole and the second hole may be formed in a 'V'-shape as a whole.

A front end of the first hole may be disposed radially outward further than a rear end of the second hole.

The hole may comprise a plurality of holes spaced apart in a circumferential direction.

The first flange portion may comprise a plurality of coupling grooves formed in the front surface of the first flange portion, and the hole may be formed between the plurality of coupling grooves in the circumferential direction.

The first flange portion may comprise a coupling groove formed in the front surface of the first flange portion, and a coupling hole spaced apart from the coupling groove in the circumferential direction. The hole may be disposed between the coupling groove and the coupling hole in the circumferential direction.

That is, space efficiency can be improved by variously applying a position of the holes.

The cylinder may comprise a second flange portion protruding radially outward from an axially front area of the cylinder. The first flange portion may comprise a flange groove formed in the inner surface of the first flange portion, and the second flange portion may be disposed in the flange groove.

The linear compressor may further comprise a first heat transfer member disposed between a surface connecting a bottom surface of the flange groove and an inner surface of the frame and a rear surface of the second flange portion.

Hence, the heat dissipation effect of the cylinder as heat transfer by conduction can be improved.

The first heat transfer member in a liquid state may be disposed and cured between the surface connecting the bottom surface of the flange groove and the inner surface of the frame and the rear surface of the second flange portion.

Hence, the heat dissipation effect of the cylinder can be improved even when a tolerance occurs in the product or micro-bubbles occur in the product.

The linear compressor may further comprise a fixing member disposed between the flange groove and an axially front end of the cylinder, and a second heat transfer member disposed between the fixing member and a front surface of the second flange portion.

The linear compressor may further comprise a third heat transfer member disposed between a bottom surface of the flange groove and an outer surface of the second flange portion. The hole may communicate with the third heat transfer member.

That is, the heat dissipation effect of the cylinder by conduction through the second and third heat transfer members can be improved.

To achieve the above-described and other objects, in another aspect of the present disclosure, there is provided a linear compressor comprising a shell, a frame disposed in the shell, the frame comprising a body portion and a first flange portion extending radially from a front of the body portion, a cylinder fixed to the body portion, and a piston disposed in the cylinder and configured to reciprocate axially, wherein the first flange portion comprises a hole penetrating a rear surface and an inner surface of the first flange portion.

In this case, the hole may communicate with an air layer formed between the inner surface of the first flange portion and an outer surface of the cylinder.

Hence, heat of a front area of the cylinder is transferred to the frame, and thus a temperature of the cylinder can be reduced. Since a temperature of a suction refrigerant introduced into the cylinder can be reduced by reducing the temperature of the cylinder, compression efficiency of the linear compressor can be improved.

The cylinder may comprise a second flange portion protruding radially outward from an axially front area of the cylinder. The first flange portion may comprise a flange groove formed in the inner surface of the first flange portion, and the second flange portion may be disposed in the flange groove.

The linear compressor may further comprise a first heat transfer member disposed between a surface connecting a bottom surface of the flange groove and an inner surface of the frame and a rear surface of the second flange portion.

Hence, the heat dissipation effect of the cylinder as heat transfer by conduction can be improved.

The first heat transfer member in a liquid state may be disposed and cured between the surface connecting the bottom surface of the flange groove and the inner surface of the frame and the rear surface of the second flange portion.

Hence, the heat dissipation effect of the cylinder can be improved even when a tolerance occurs in the product or micro-bubbles occur in the product.

The linear compressor may further comprise a fixing member disposed between the flange groove and an axially front end of the cylinder, a second heat transfer member disposed between the fixing member and a front surface of the second flange portion, and a third heat transfer member disposed between a bottom surface of the flange groove and an outer surface of the second flange portion.

That is, the heat dissipation effect of the cylinder by conduction through the second and third heat transfer members can be improved.

According to an embodiment, the present disclosure can provide a linear compressor capable of improving compression efficiency.

According to an embodiment, the present disclosure can provide a linear compressor capable of reducing a temperature of a cylinder.

According to an embodiment, the present disclosure can provide a linear compressor capable of improving a heat dissipation effect of a cylinder as heat transfer by conduction.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

FIG. 16 is a cross-sectional view of a partial configuration of a linear compressor according to a related art.

FIG. 17 schematically illustrates a temperature distribution of a cylinder and a frame of a linear compressor according to a related art.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

In embodiments of the disclosure, when an arbitrary component is described as "being connected to" or "being coupled to" other component, it should be understood that another component(s) may exist between them, although the arbitrary component may be directly connected or coupled to the other component.

It will be noted that a detailed description of known arts will be omitted if it is determined that the detailed description of the known arts can obscure embodiments of the disclosure. The accompanying drawings are used to help easily understand various technical features and it should be understood that embodiments presented herein are not limited by the accompanying drawings. As such, the present disclosure should be understand to extend to any alterations, equivalents and substitutes in addition to those which are particularly set out in the accompanying drawings.

In addition, a term of "disclosure" may be replaced by document, specification, description, etc.

Figure 1:
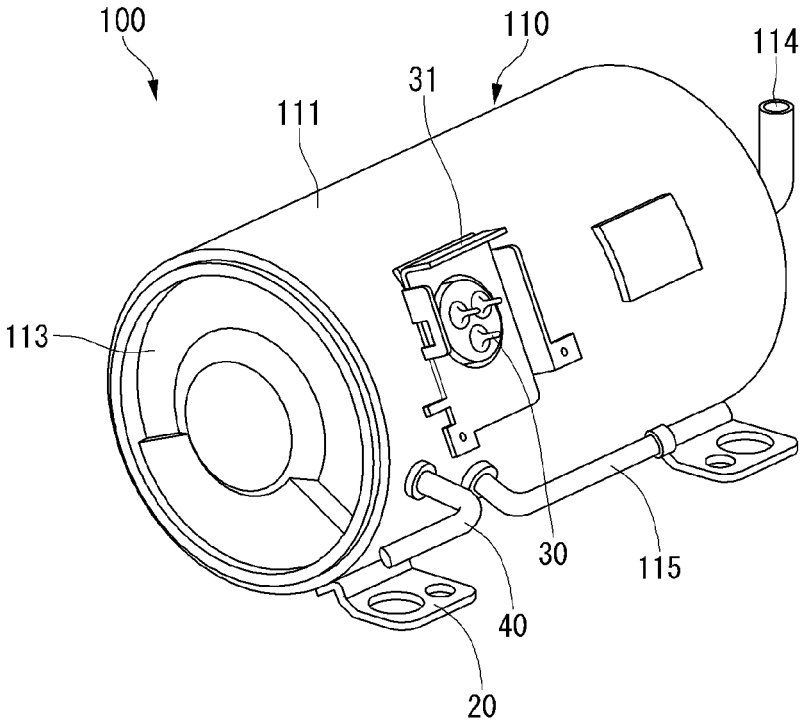
FIG. 1 is a perspective view of a linear compressor according to an embodiment of the present disclosure.

FIG. 1 is a perspective view of a linear compressor according to an embodiment of the disclosure.

Referring to FIG. 1, a linear compressor 100 according to an embodiment of the disclosure may include a shell 111 and shell covers 112 and 113 coupled to the shell 111. In a broad sense, the shell covers 112 and 113 can be understood as one configuration of the shell 111.

Legs 20 may be coupled to a lower side of the shell 111. The legs 20 may be coupled to a base of a product on which the linear compressor 100 is mounted. For example, the product may include a refrigerator, and the base may include a machine room base of the refrigerator. As another example, the product may include an outdoor unit of an air conditioner, and the base may include a base of the outdoor unit.

The shell 111 may have a substantially cylindrical shape and may be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the compressor 100 to be described later, and the central axis of the main body of the compressor 100 coincides with a central axis of a cylinder 140 and a piston 150 constituting the main body of the compressor 100.

A terminal 30 may be installed on an external surface of the shell 111. The terminal 30 may transmit external electric power to a drive unit 130 of the linear compressor 100. More specifically, the terminal 30 may be connected to a lead line of a coil 132*b*.

A bracket 31 may be installed on the outside of the terminal 30. The bracket 31 may include a plurality of brackets surrounding the terminal 30. The bracket 31 may perform a function of protecting the terminal 30 from an external impact, etc.

Both sides of the shell 111 may be opened. The shell covers 112 and 113 may be coupled to both sides of the opened shell 111. More specifically, the shell covers 112 and 113 may include a first shell cover 112 coupled to one opened side of the shell 111 and a second shell cover 113 coupled to the other opened side of the shell 111. An inner space of the shell 111 may be closed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 may be disposed to face each other. It can be understood that the first shell cover 112 is positioned on a suction side of a refrigerant, and the second shell cover 113 is positioned on a discharge side of the refrigerant.

The linear compressor 100 may include a plurality of pipes 114, 115, and 40 that is included in the shell 111 or the shell covers 112 and 113 and can suck, discharge, or inject the refrigerant.

The plurality of pipes 114, 115, and 40 may include a suction pipe 114 that allows the refrigerant to be sucked into the linear compressor 100, a discharge pipe 115 that allows the compressed refrigerant to be discharged from the linear compressor 100, and a supplementary pipe 40 for supplementing the refrigerant in the linear compressor 100.

For example, the suction pipe 114 may be coupled to the first shell cover 112. The refrigerant may be sucked into the linear compressor 100 along the axial direction through the suction pipe 114.

The discharge pipe 115 may be coupled to an outer circumferential surface of the shell 111. The refrigerant sucked through the suction pipe 114 may be compressed while flowing in the axial direction. The compressed refrigerant may be discharged through the discharge pipe 115. The discharge pipe 115 may be disposed closer to the second shell cover 113 than to the first shell cover 112.

The supplementary pipe 40 may be coupled to the outer circumferential surface of the shell 111. A worker may inject the refrigerant into the linear compressor 100 through the supplementary pipe 40.

The supplementary pipe 40 may be coupled to the shell 111 at a different height from the discharge pipe 115 in order to prevent interference with the discharge pipe 115. Here, the height may be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 may be positioned adjacently. In other words, at least a portion of the second shell cover 113 may act as a resistance of the refrigerant injected through the supplementary pipe 40.

Thus, with respect to a flow path of the refrigerant, a size of the flow path of the refrigerant introduced through the supplementary pipe 40 is configured to decrease by the second shell cover 113 while the refrigerant enters into the inner space of the shell 111, and again increase while the refrigerant passes through the second shell cover 113. In this process, a pressure of the refrigerant may be reduced to vaporize the refrigerant, and an oil contained in the refrigerant may be separated. Thus, while the refrigerant, from which the oil is separated, is introduced into the piston 150, a compression performance of the refrigerant can be improved. The oil may be understood as a working oil present in a cooling system.

Figure 2:
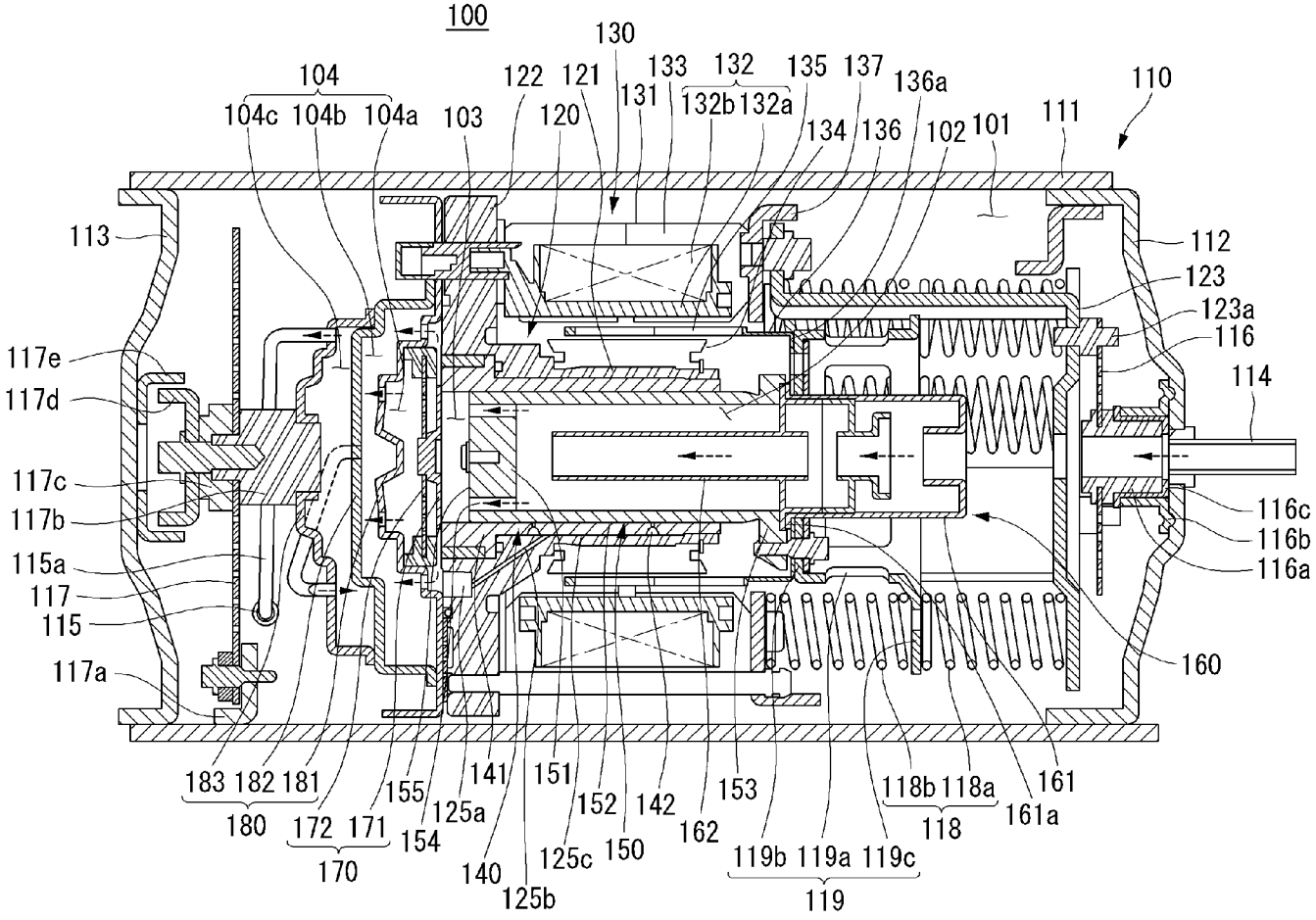
FIG. 2 is a cross-sectional view of a linear compressor according to an embodiment of the present disclosure.

FIG. 2 is a cross-sectional view of a linear compressor according to an embodiment of the disclosure.

Hereinafter, a linear compressor according to the present disclosure will be described taking, as an example, a linear compressor that sucks and compresses a fluid while a piston linearly reciprocates, and discharges the compressed fluid.

The linear compressor may be a component of a refrigeration cycle, and the fluid compressed in the linear compressor may be a refrigerant circulating the refrigeration cycle. The refrigeration cycle may include a condenser, an expander, an evaporator, etc., in addition to the compressor. The linear compressor may be used as a component of the cooling system of the refrigerator, but is not limited thereto. The linear compressor can be widely used in the whole industry.

Referring to FIG. 2, the compressor 100 may include a casing 110 and a main body accommodated in the casing 110. The main body of the compressor 100 may include a frame 120, the cylinder 140 fixed to the frame 120, the piston 150 that linearly reciprocates inside the cylinder 140, the drive unit 130 that is fixed to the frame 120 and gives a driving force to the piston 150, and the like. Here, the cylinder 140 and the piston 150 may be referred to as compression units 140 and 150.

The compressor 100 may include a bearing means for reducing a friction between the cylinder 140 and the piston 150. The bearing means may be an oil bearing or a gas bearing. Alternatively, a mechanical bearing may be used as the bearing means.

The main body of the compressor 100 may be elastically supported by support springs 116 and 117 installed at both ends inside the casing 110. The support springs 116 and 117 may include a first support spring 116 for supporting the rear of the main body and a second support spring 117 for supporting the front of the main body. The support springs 116 and 117 may include a leaf spring. The support springs 116 and 117 can absorb vibrations and impacts generated by a reciprocating motion of the piston 150 while supporting the internal parts of the main body of the compressor 100.

The casing 110 may form a sealed space. The sealed space may include an accommodation space 101 in which the sucked refrigerant is accommodated, a suction space 102 which is filled with the refrigerant before the compression, a compression space 103 in which the refrigerant is compressed, and a discharge space 104 which is filled with the compressed refrigerant.

The refrigerant sucked from the suction pipe 114 connected to the rear side of the casing 110 may be filled in the accommodation space 101, and the refrigerant in the suction space 102 communicating with the accommodation space 101 may be compressed in the compression space 103, discharged to the discharge space 104, and discharged to the outside through the discharge pipe 115 connected to the front side of the casing 110.

The casing 110 may include the shell 111 formed in a substantially cylindrical shape that is open at both ends and is long in a transverse direction, the first shell cover 112 coupled to the rear side of the shell 111, and the second shell cover 113 coupled to the front side of the shell 111. Here, it can be understood that the front side is the left side of the figure and is a direction in which the compressed refrigerant is discharged, and the rear side is the right side of the figure and is a direction in which the refrigerant is introduced. Further, the first shell cover 112 and the second shell cover 113 may be formed as one body with the shell 111.

The casing 110 may be formed of a thermally conductive material. Hence, heat generated in the inner space of the casing 110 can be quickly dissipated to the outside.

The first shell cover 112 may be coupled to the shell 111 in order to seal the rear of the shell 111, and the suction pipe 114 may be inserted and coupled to the center of the first shell cover 112.

The rear of the main body of the compressor 100 may be elastically supported by the first support spring 116 in the radial direction of the first shell cover 112.

The first support spring 116 may include a circular leaf spring. An edge of the first support spring 116 may be elastically supported by a support bracket **123*a* in a forward direction with respect to a back cover 123. An opened center portion of the first support spring 116 may be supported by a suction guide 116*a* in a rearward direction with respect to the first shell cover 112**.

The suction guide **116*a* may have a through passage formed therein. The suction guide 116*a* may be formed in a cylindrical shape. A front outer circumferential surface of the suction guide 116*a* may be coupled to a central opening of the first support spring 116, and a rear end of the suction guide 116*a* may be supported by the first shell cover 112. In this instance, a separate suction side support member 116*b* may be interposed between the suction guide 116*a* and an inner surface of the first shell cover 112**.

A rear side of the suction guide **116*a* may communicate with the suction pipe 114, and the refrigerant sucked through the suction pipe 114 may pass through the suction guide 116*a* and may be smoothly introduced into a muffler unit 160** to be described later.

A damping member **116*c* may be disposed between the suction guide 116*a*** and the suction side support member 116*b*. The damping member 116*c* may be formed of a rubber material or the like. Hence, a vibration that may occur in the process of sucking the refrigerant through the suction pipe 114 can be prevented from being transmitted to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then may be discharged into the refrigeration cycle through the loop pipe 115*a* and the discharge pipe 115.

A front side of the main body of the compressor 100 may be elastically supported by the second support spring 117 in the radial direction of the shell 111 or the second shell cover 113.

The second support spring 117 may include a circular leaf spring. An opened center portion of the second support spring 117 may be supported by a first support guide 117*b* in a rearward direction with respect to the discharge cover assembly 180. An edge of the second support spring 117 may be supported by a support bracket 117*a* in a forward direction with respect to the inner surface of the shell 111 or the inner circumferential surface of the shell 111 adjacent to the second shell cover 113.

Unlike FIG. 2, the edge of the second support spring 117 may be supported in the forward direction with respect to the inner surface of the shell 111 or the inner circumferential surface of the shell 111 adjacent to the second shell cover 113 through a separate bracket (not shown) coupled to the second shell cover 113.

The first support guide 117*b* may be formed in a cylindrical shape. A cross section of the first support guide 117*b* may have a plurality of diameters. A front side of the first support guide 117*b* may be connected to the second support spring 117, and a rear side of the first support guide 117 may be inserted into a central opening of the discharge cover assembly 180. A support cover 117*c* may be coupled to the front side of the first support guide 117*b* with the second support spring 117 interposed therebetween. A cup-shaped second support guide 117*d* that is recessed forward may be coupled to the front side of the support cover 117*c*. A cup-shaped third support guide 117*e* that corresponds to the second support guide 117*d* and is recessed rearward may be coupled to the inside of the second shell cover 113. The second support guide 117*d* may be inserted into the third support guide 117*e* and may be supported in the axial direction and/or the radial direction. In this instance, a gap may be formed between the second support guide 117*d* and the third support guide 117*e*.

The frame 120 may include a body portion 121 supporting the outer circumferential surface of the cylinder 140, and a first flange portion 122 that is connected to one side of the body portion 121 and supports the drive unit 130. The frame 120 may be elastically supported with respect to the casing 110 by the first and second support springs 116 and 117 together with the drive unit 130 and the cylinder 140.

The body portion 121 may wrap the outer circumferential surface of the cylinder 140. The body portion 121 may be formed in a cylindrical shape. The first flange portion 122 may extend from a front end of the body portion 121 in the radial direction.

The cylinder 140 may be coupled to an inner circumferential surface of the body portion 121. An inner stator 134 may be coupled to an outer circumferential surface of the body portion 121. For example, the cylinder 140 may be pressed and fitted to the inner circumferential surface of the body portion 121, and the inner stator 134 may be fixed using a separate fixing ring (not shown).

An outer stator 131 may be coupled to a rear surface of the first flange portion 122, and the discharge cover assembly 180 may be coupled to a front surface of the first flange portion 122. For example, the outer stator 131 and the discharge cover assembly 180 may be fixed through a mechanical coupling means.

On one side of the front surface of the first flange portion 122, a bearing inlet groove 125*a* forming a part of the gas bearing may be formed, a bearing communication hole 125*b* penetrating from the bearing inlet groove 125*a* to the inner circumferential surface of the body portion 121 may be formed, and a gas groove 125*c* communicating with the bearing communication hole 125*b* may be formed on the inner circumferential surface of the body portion 121.

The bearing inlet groove 125*a* may be recessed to a predetermined depth in the axial direction. The bearing communication hole 125*b* is a hole having a smaller cross-sectional area than the bearing inlet groove 125*a* and may be inclined toward the inner circumferential surface or the inside surface of the body portion 121. The gas groove 125*c* may be formed in an annular shape having a predetermined depth and an axial length on the inner circumferential surface of the body portion 121. Alternatively, the gas groove 125*c* may be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* may be formed on the outer circumferential surface of the cylinder 140. The gas inlet 142 forms a kind of nozzle in the gas bearing.

The frame 120 and the cylinder 140 may be formed of aluminum or an aluminum alloy material.

The cylinder 140 may be formed in a cylindrical shape that is open at both ends. The piston 150 may be inserted through a rear end of the cylinder 140. A front end of the cylinder 140 may be closed via a discharge valve assembly 170. The compression space 103 may be formed between the cylinder 140, a front end of the piston 150, and the discharge valve assembly 170. Here, the front end of the piston 150 may be referred to as a head 151. The compression space 103 increases in volume when the piston 150 moves backward, and decreases in volume as the piston 150 moves forward. That is, the refrigerant introduced into the compression space 103 may be compressed while the piston 150 moves forward, and may be discharged through the discharge valve assembly 170.

The cylinder 140 may include a second flange portion 141 disposed at the front end. The second flange portion 141 may bend to the outside of the cylinder 140. The second flange portion 141 may extend in an outer circumferential direction of the cylinder 140. The second flange portion 141 of the cylinder 140 may be coupled to the frame 120. For example, the front end of the frame 120 may include a flange groove corresponding to the second flange portion 141 of the cylinder 140, and the second flange portion 141 of the cylinder 140 may be inserted into the flange groove and coupled through a coupling member.

A gas bearing means may be provided to supply a discharge gas to a gap between the outer circumferential surface of the piston 150 and the outer circumferential surface of the cylinder 140 and lubricate between the cylinder 140 and the piston 150 with gas. The discharge gas between the cylinder 140 and the piston 150 may provide a floating force to the piston 150 to reduce a friction generated between the piston 150 and the cylinder 140.

For example, the cylinder 140 may include the gas inlet 142. The gas inlet 142 may communicate with the gas groove 125*c* formed on the inner circumferential surface of the body portion 121. The gas inlet 142 may pass through the cylinder 140 in the radial direction. The gas inlet 142 may guide the compressed refrigerant introduced in the gas groove 125*c* between the inner circumferential surface of the cylinder 140 and the outer circumferential surface of the piston 150. Alternatively, the gas groove 125*c* may be formed on the outer circumferential surface of the cylinder 140 in consideration of the convenience of processing.

An entrance of the gas inlet 142 may be formed relatively widely, and an exit of the gas inlet 142 may be formed as a fine through hole to serve as a nozzle. The entrance of the gas inlet 142 may further include a filter (not shown) blocking the inflow of foreign matter. The filter may be a metal mesh filter, or may be formed by winding a member such as fine thread.

The plurality of gas inlets 142 may be independently formed. Alternatively, the entrance of the gas inlet 142 may be formed as an annular groove, and a plurality of exits may be formed along the annular groove at regular intervals. The gas inlet 142 may be formed only at the front side based on the axial middle of the cylinder 140. On the contrary, the gas inlet 142 may be formed at the rear side based on the axial middle of the cylinder 140 in consideration of the sagging of the piston 150.

The piston 150 is inserted into the opened rear end of the cylinder 140 and is provided to seal the rear of the compression space 103.

The piston 150 may include a head 151 and a guide 152. The head 151 may be formed in a disc shape. The head 151 may be partially open. The head 151 may partition the compression space 103. The guide 152 may extend rearward from an outer circumferential surface of the head 151. The guide 152 may be formed in a cylindrical shape. The inside of the guide 152 may be empty, and the front of the guide 152 may be partially sealed by the head 151. The rear of the guide 152 may be opened and connected to the muffler unit 160. The head 151 may be provided as a separate member coupled to the guide 152. Alternatively, the head 151 and the guide 152 may be formed as one body.

The piston 150 may include a suction port 154. The suction port 154 may pass through the head 151. The suction port 154 may communicate with the suction space 102 and the compression space 103 inside the piston 150. For example, the refrigerant flowing from the accommodation space 101 to the suction space 102 inside the piston 150 may pass through the suction port 154 and may be sucked into the compression space 103 between the piston 150 and the cylinder 140.

The suction port 154 may extend in the axial direction of the piston 150. The suction port 154 may be inclined in the axial direction of the piston 150. For example, the suction port 154 may extend to be inclined in a direction away from the central axis as it goes to the rear of the piston 150.

A cross section of the suction port 154 may be formed in a circular shape. The suction port 154 may have a constant inner diameter. In contrast, the suction port 154 may be formed as a long hole in which an opening extends in the radial direction of the head 151, or may be formed such that the inner diameter becomes larger as it goes to the rear.

The plurality of suction ports 154 may be formed in one or more of the radial direction and the circumferential direction of the head 151.

The head 151 of the piston 150 adjacent to the compression space 103 may be equipped with a suction valve 155 for selectively opening and closing the suction port 154. The suction valve 155 may operate by elastic deformation to open or close the suction port 154. That is, the suction valve 155 may be elastically deformed to open the suction port 154 by the pressure of the refrigerant flowing into the compression space 103 through the suction port 154. The suction valve 155 may be a lead valve, but is not limited thereto and may be variously changed.

The piston 150 may be connected to a mover 135. The mover 135 may reciprocate forward and backward according to the movement of the piston 150. The inner stator 134 and the cylinder 140 may be disposed between the mover 135 and the piston 150. The mover 135 and the piston 150 may be connected to each other by a magnet frame 136 that is formed by detouring the cylinder 140 and the inner stator 134 to the rear.

The muffler unit 160 may be coupled to the rear of the piston 150 to reduce a noise generated in the process of sucking the refrigerant into the piston 150. The refrigerant sucked through the suction pipe 114 may flow into the suction space 102 inside the piston 150 via the muffler unit 160.

The muffler unit 160 may include a suction muffler 161 communicating with the accommodation space 101 of the casing 110, and an inner guide 162 that is connected to the front of the suction muffler 161 and guides the refrigerant to the suction port 154.

The suction muffler 161 may be positioned in the rear of the piston 150. A rear opening of the suction muffler 161 may be disposed adjacent to the suction pipe 114, and a front end of the suction muffler 161 may be coupled to the rear of the piston 150. The suction muffler 161 may have a flow path formed in the axial direction to guide the refrigerant in the accommodation space 101 to the suction space 102 inside the piston 150.

The inside of the suction muffler 161 may include a plurality of noise spaces partitioned by a baffle. The suction muffler 161 may be formed by combining two or more members. For example, a second suction muffler may be press-coupled to the inside of a first suction muffler to form a plurality of noise spaces. In addition, the suction muffler 161 may be formed of a plastic material in consideration of weight or insulation property.

One side of the inner guide 162 may communicate with the noise space of the suction muffler 161, and other side may be deeply inserted into the piston 150. The inner guide 162 may be formed in a pipe shape. Both ends of the inner guide 162 may have the same inner diameter. The inner guide 162 may be formed in a cylindrical shape. Alternatively, an inner diameter of a front end that is a discharge side of the inner guide 162 may be greater than an inner diameter of a rear end opposite the front end.

The suction muffler 161 and the inner guide 162 may be provided in various shapes and may adjust the pressure of the refrigerant passing through the muffler unit 160. The suction muffler 161 and the inner guide 162 may be formed as one body.

The discharge valve assembly 170 may include a discharge valve 171 and a valve spring 172 that is provided on a front side of the discharge valve 171 to elastically support the discharge valve 171. The discharge valve assembly 170 may selectively discharge the compressed refrigerant in the compression space 103. Here, the compression space 103 means a space between the suction valve 155 and the discharge valve 171.

The discharge valve 171 may be disposed to be supportable on the front surface of the cylinder 140. The discharge valve 171 may selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, the compression space 103 may maintain a sealed state while the discharge valve 171 is supported on the front surface of the cylinder 140, and the compressed refrigerant of the compression space 103 may be discharged to an opened space in a state where the discharge valve 171 is spaced apart from the front surface of the cylinder 140. The discharge valve 171 may be a lead valve, but is not limited thereto and may be variously changed.

The valve spring 172 may be provided between the discharge valve 171 and the discharge cover assembly 180 to provide an elastic force in the axial direction. The valve spring 172 may be provided as a compression coil spring, or may be provided as a leaf spring in consideration of an occupied space or reliability.

When the pressure of the compression space 103 is equal to or greater than a discharge pressure, the valve spring 172 may open the discharge valve 171 while deforming forward, and the refrigerant may be discharged from the compression space 103 and discharged to a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the suction valve 155 and discharging the refrigerant of the compression space 103 to the discharge space 104 through the discharge valve 171 is described as follows.

In the process in which the piston 150 linearly reciprocates inside the cylinder 140, if the pressure of the compression space 103 is equal to or less than a predetermined suction pressure, the suction valve 155 is opened and thus the refrigerant is sucked into a compression space 103. On the other hand, if the pressure of the compression space 103 exceeds the predetermined suction pressure, the refrigerant of the compression space 103 is compressed in a state in which the suction valve 155 is closed.

If the pressure of the compression space 103 is equal to or greater than the predetermined suction pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing the front of the compression space 103.

The discharge cover assembly 180 is installed in front of the compression space 103, forms a discharge space 104 for accommodating the refrigerant discharged from the compression space 103, and is coupled to the front of the frame 120 to thereby reduce a noise generated in the process of discharging the refrigerant from the compression space 103. The discharge cover assembly 180 may be coupled to the front of the first flange portion 122 of the frame 120 while accommodating the discharge valve assembly 170. For example, the discharge cover assembly 180 may be coupled to the first flange portion 122 through a mechanical coupling member.

An O-ring 166 may be provided between the discharge cover assembly 180 and the frame 120 to prevent the refrigerant in a gasket 165 for thermal insulation and the discharge space 104 from leaking.

The discharge cover assembly 180 may be formed of a thermally conductive material. Therefore, when a high temperature refrigerant is introduced into the discharge cover assembly 180, heat of the refrigerant may be transferred to the casing 110 through the discharge cover assembly 180 and dissipated to the outside of the compressor.

The discharge cover assembly 180 may include one discharge cover, or may be arranged so that a plurality of discharge covers sequentially communicates with each other. When the discharge cover assembly 180 is provided with the plurality of discharge covers, the discharge space 104 may include a plurality of spaces partitioned by the respective discharge covers. The plurality of spaces may be disposed in a front-rear direction and may communicate with each other.

For example, when there are three discharge covers, the discharge space 104 may include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* may selectively communicate with the compression space 103 by the discharge valve 171, the second discharge space 104*b* may communicate with the first discharge space 104*a*, and the third discharge space 104*c* may communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The drive unit 130 may include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 may be coupled to the rear of the first flange portion 122 of the frame 120, and the inner stator 134 may be coupled to the outer circumferential surface of the body portion 121 of the frame 120. The inner stator 134 may be spaced apart from the inside of the outer stator 131, and the mover 135 may be disposed in a space between the outer stator 131 and the inner stator 134.

The outer stator 131 may be equipped with a winding coil, and the mover 135 may include a permanent magnet. The permanent magnet may consist of a single magnet with one pole or configured by combining a plurality of magnets with three poles.

The outer stator 131 may include a coil winding 132 surrounding the axial direction in the circumferential direction and a stator core 133 stacked while surrounding the coil winding 132. The coil winding 132 may include a hollow cylindrical bobbin 132*a* and a coil 132*b* wound in a circumferential direction of the bobbin 132*a*. A cross section of the coil 132*b* may be formed in a circular or polygonal shape, for example, may have a hexagonal shape. In the stator core 133, a plurality of lamination sheets may be laminated radially, or a plurality of lamination blocks may be laminated along the circumferential direction.

The front side of the outer stator 131 may be supported by the first flange portion 122 of the frame 120, and the rear side thereof may be supported by a stator cover 137. For example, the stator cover 137 may be provided in a hollow disc shape, a front surface of the stator cover 137 may be supported by the outer stator 131, and a rear surface thereof may be supported by a resonant spring 118.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and may be disposed to be inserted into a space between the outer stator 131 and the inner stator 134. The magnet frame 136 may be coupled to the rear side of the piston 150 to move together with the piston 150.

As an example, a rear end of the magnet frame 136 is bent and extended inward in the radial direction to form a first coupling portion 136*a*, and the first coupling portion 136*a* may be coupled to a third flange portion 153 formed in the rear of the piston 150. The first coupling portion 136*a* of the magnet frame 136 and the third flange portion 153 of the piston 150 may be coupled through a mechanical coupling member.

A fourth flange portion 161*a* in front of the suction muffler 161 may be interposed between the third flange portion 153 of the piston 150 and the first coupling portion 136*a* of the magnet frame 136. Thus, the piston 150, the muffler unit 160, and the mover 135 can linearly reciprocate together in a combined state.

When a current is applied to the drive unit 130, a magnetic flux may be formed in the winding coil, and an electromagnetic force may occur by an interaction between the magnetic flux formed in the winding coil of the outer stator 131 and a magnetic flux formed by the permanent magnet of the mover 135 to move the mover 135. At the same time as the axial reciprocating movement of the mover 135, the piston 150 connected to the magnet frame 136 may also reciprocate integrally with the mover 135 in the axial direction.

The drive unit 130 and the compression units 140 and 150 may be supported by the support springs 116 and 117 and the resonant spring 118 in the axial direction.

The resonant spring 118 amplifies the vibration implemented by the reciprocating motion of the mover 135 and the piston 150 and thus can achieve an effective compression of the refrigerant. More specifically, the resonant spring 118 may be adjusted to a frequency corresponding to a natural frequency of the piston 150 to allow the piston 150 to perform a resonant motion. Further, the resonant spring 118 generates a stable movement of the piston 150 and thus can reduce the generation of vibration and noise.

The resonant spring 118 may be a coil spring extending in the axial direction. Both ends of the resonant spring 118 may be connected to a vibrating body and a fixed body, respectively. For example, one end of the resonant spring 118 may be connected to the magnet frame 136, and the other end may be connected to the back cover 123. Therefore, the resonant spring 118 may be elastically deformed between the vibrating body vibrating at one end and the fixed body fixed to the other end.

A natural frequency of the resonant spring 118 may be designed to match a resonant frequency of the mover 135 and the piston 150 during the operation of the compressor 100, thereby amplifying the reciprocating motion of the piston 150. However, because the back cover 123 provided as the fixing body is elastically supported by the first support spring 116 in the casing 110, the back cover 123 may not be strictly fixed.

The resonant spring 118 may include a first resonant spring 118*a* supported on the rear side and a second resonant spring 118*b* supported on the front side based on a spring supporter 119.

The spring supporter 119 may include a body portion 119*a* surrounding the suction muffler 161, a second coupling portion 119*b* that is bent from the front of the body portion 119*a* in the inward radial direction, and a support portion 119*c* that is bent from the rear of the body portion 119*a* in the outward radial direction.

A front surface of the second coupling portion 119*b* of the spring supporter 119 may be supported by the first coupling portion 136*a* of the magnet frame 136. An inner diameter of the second coupling portion 119*b* of the spring supporter 119 may cover an outer diameter of the suction muffler 161. For example, the second coupling portion 119*b* of the spring supporter 119, the first coupling portion 136*a* of the magnet frame 136, and the third flange portion 153 of the piston 150 may be sequentially disposed and then integrally coupled via a mechanical member. In this instance, the description that the fourth flange portion 161*a* of the suction muffler 161 can be interposed between the third flange portion 153 of the piston 150 and the first coupling portion 136*a* of the magnet frame 136, and they can be fixed together is the same as that described above.

The first resonant spring 118*a* may be disposed between a front surface of the back cover 123 and a rear surface of the spring supporter 119. The second resonant spring 118*b* may be disposed between a rear surface of the stator cover 137 and a front surface of the spring supporter 119.

A plurality of first and second resonant springs 118*a* and 118*b* may be disposed in the circumferential direction of the central axis. The first resonant springs 118*a* and the second resonant springs 118*b* may be disposed parallel to each other in the axial direction, or may be alternately disposed. The first and second resonant springs 118*a* and 118*b* may be disposed at regular intervals in the radial direction of the central axis. For example, three first resonant springs 118*a* and three second resonant springs 118*b* may be provided and may be disposed at intervals of 120 degrees in the radial direction of the central axis.

The compressor 100 may include a plurality of sealing members that can increase a coupling force between the frame 120 and the components around the frame 120.

For example, the plurality of sealing members may include a first sealing member that is interposed at a portion where the frame 120 and the discharge cover assembly 180 are coupled and is inserted into an installation groove provided at the front end of the frame 120, and a second sealing member that is provided at a portion at which the frame 120 and the cylinder 140 are coupled and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members may further include a third sealing member that is provided at a portion at which the frame 120 and the inner stator 134 are coupled and is inserted into an installation groove provided at the outer surface of the frame 120. Here, the first to third sealing members may have a ring shape.

An operation of the linear compressor 100 described above is as follows.

First, when a current is applied to the drive unit 130, a magnetic flux may be formed in the outer stator 131 by the current flowing in the coil 132*b*. The magnetic flux formed in the outer stator 131 may generate an electromagnetic force, and the mover 135 including the permanent magnet may linearly reciprocate by the generated electromagnetic force. The electromagnetic force is generated in a direction (forward direction) in which the piston 150 is directed toward a top dead center (TDC) during a compression stroke, and is alternately generated in a direction (rearward direction) in which the piston 150 is directed toward a bottom dead center (BDC) during a suction stroke. That is, the drive unit 130 may generate a thrust which is a force for pushing the mover 135 and the piston 150 in a moving direction.

The piston 150 linearly reciprocating inside the cylinder 140 may repeatedly increase or reduce volume of the compression space 103.

When the piston 150 moves in a direction (rearward direction) of increasing the volume of the compression space 103, a pressure of the compression space 103 may decrease. Hence, the suction valve 155 mounted in front of the piston 150 is opened, and the refrigerant remaining in the suction space 102 may be sucked into the compression space 103 along the suction port 154. The suction stroke may be performed until the piston 150 is positioned in the bottom dead center by maximally increasing the volume of the compression space 103.

The piston 150 reaching the bottom dead center may perform the compression stroke which switching its motion direction and moving in a direction (forward direction) of reducing the volume of the compression space 103. As the pressure of the compression space 103 increases during the compression stroke, the sucked refrigerant may be compressed. When the pressure of the compression space 103 reaches a setting pressure, the discharge valve 171 is pushed out by the pressure of the compression space 103 and is opened from the cylinder 140, and the refrigerant can be discharged to the discharge space 104 through a separation space. The compression stroke can continue while the piston 150 moves to the top dead center at which the volume of the compression space 103 is minimized.

As the suction stroke and the compression stroke of the piston 150 are repeated, the refrigerant introduced into the accommodation space 101 inside the compressor 100 through the suction pipe 114 may be introduced into the suction space 102 inside the piston 150 by sequentially passing the suction guide 116*a*, the suction muffler 161, and the inner guide 162, and the refrigerant of the suction space 102 may be introduced into the compression space 103 inside the cylinder 140 during the suction stroke of the piston 150. After the refrigerant of the compression space 103 is compressed and discharged to the discharge space 104 during the compression stroke of the piston 150, the refrigerant may be discharged to the outside of the compressor 100 via the loop pipe 115*a* and the discharge pipe 115.

Figure 3:
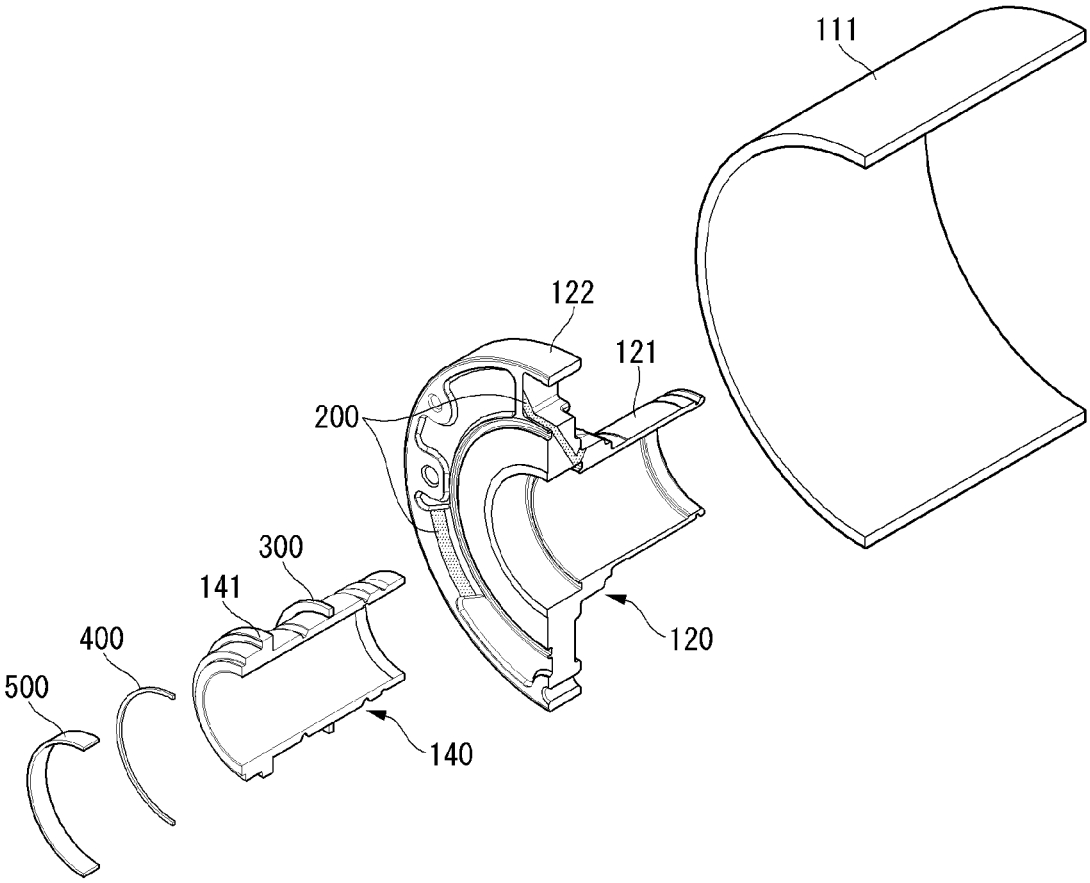
FIG. 3 is a cross-sectional exploded perspective view of a partial configuration of a linear compressor according to an embodiment of the present disclosure.
Figure 4:
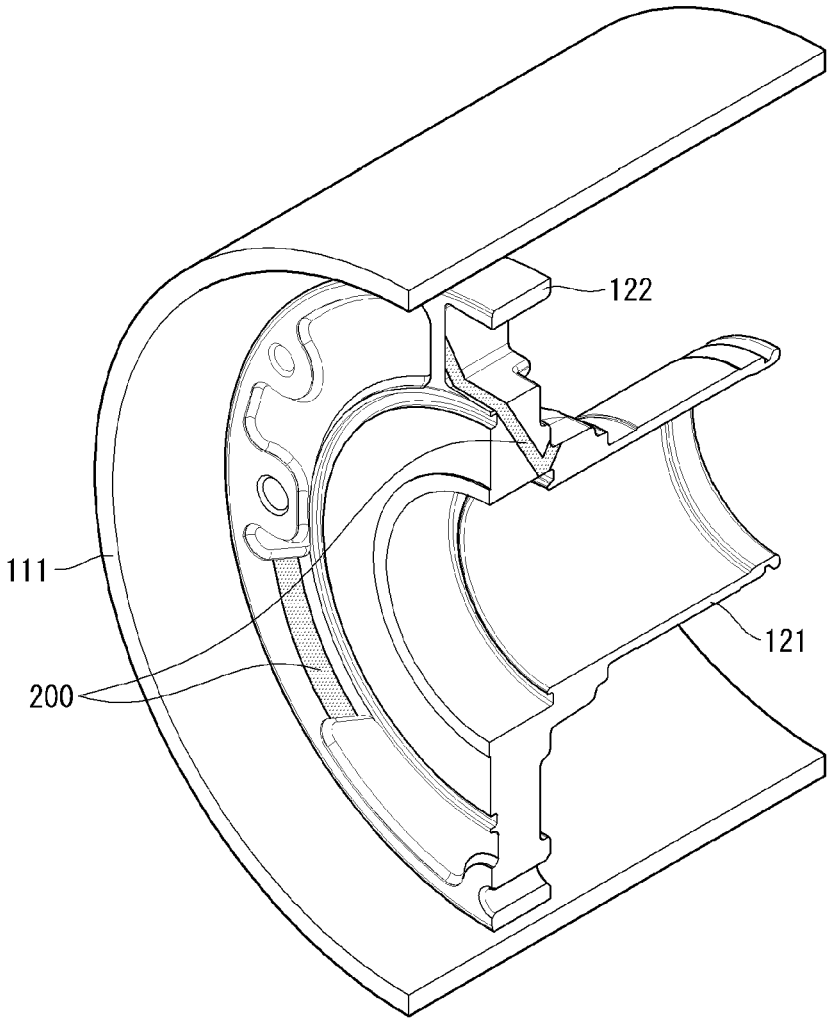
FIG. 4 is a cross-sectional perspective view of a partial configuration of a linear compressor according to an embodiment of the present disclosure.
Figure 5:
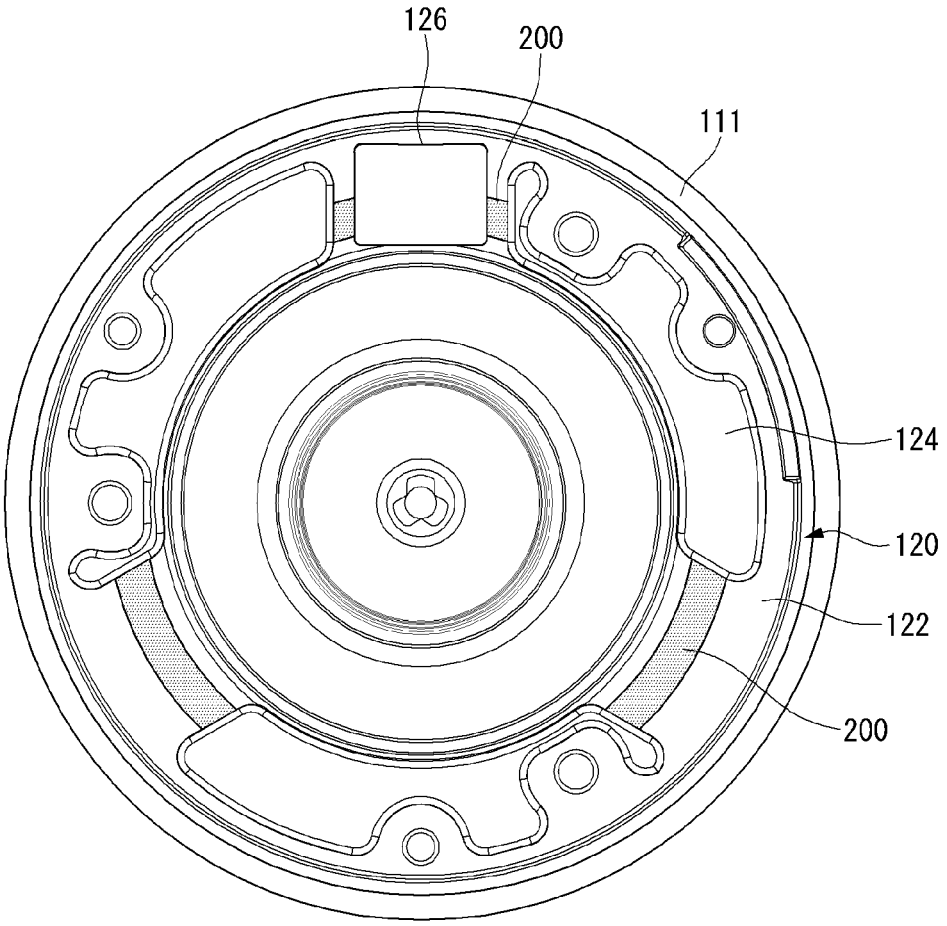
FIG. 5 is a front view of a partial configuration of a linear compressor according to an embodiment of the present disclosure.
Figure 6:
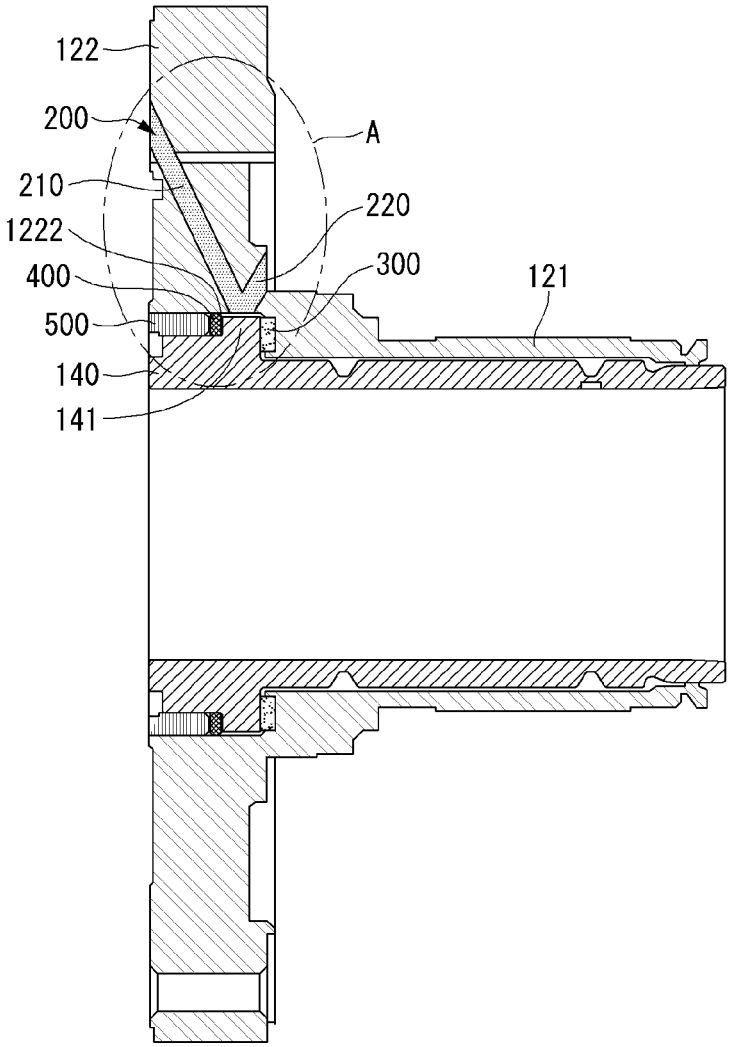
FIG. 6 is a cross-sectional view of a linear compressor according to an embodiment of the present disclosure.
Figure 7:
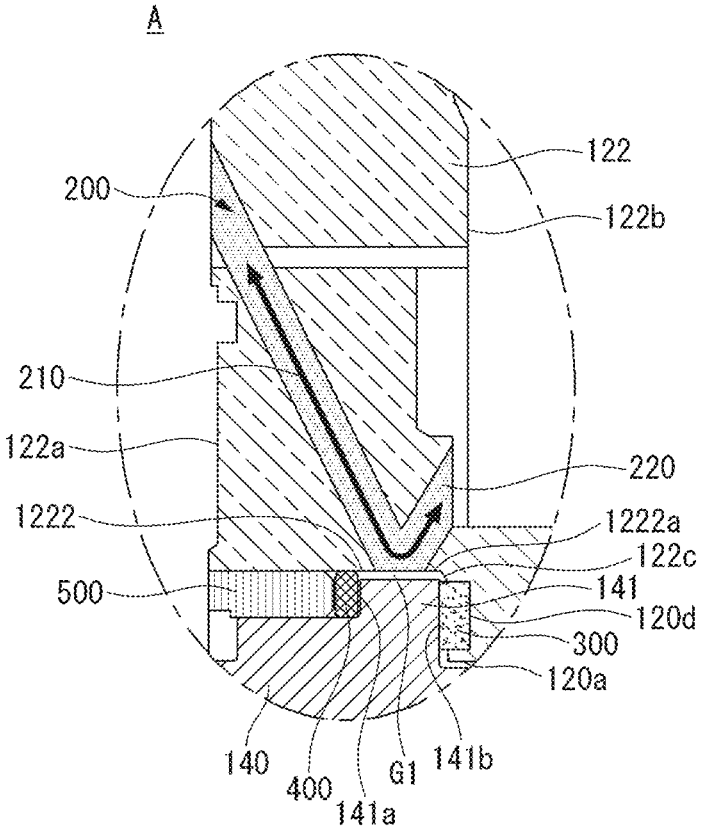
FIG. 7 is a partial enlarged view of a portion 'A' of FIG. 6.
Figure 8:
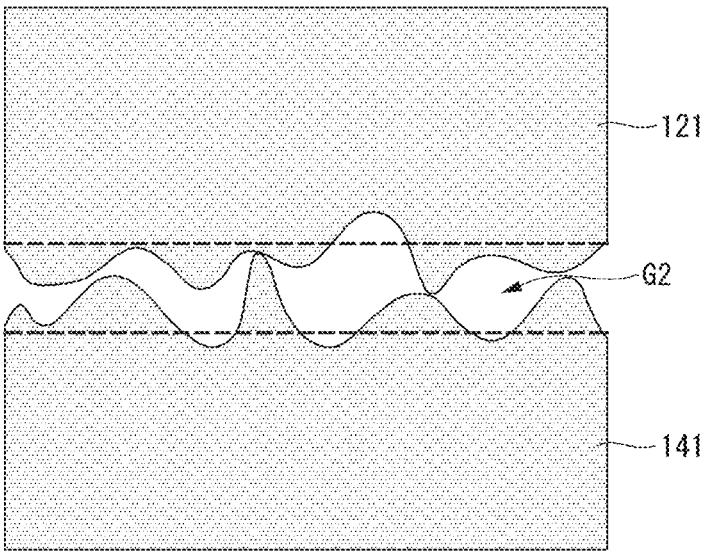
FIG. 8 schematically illustrates a space between a cylinder and a second flange portion of a linear compressor according to an embodiment of the present disclosure.
Figure 9:
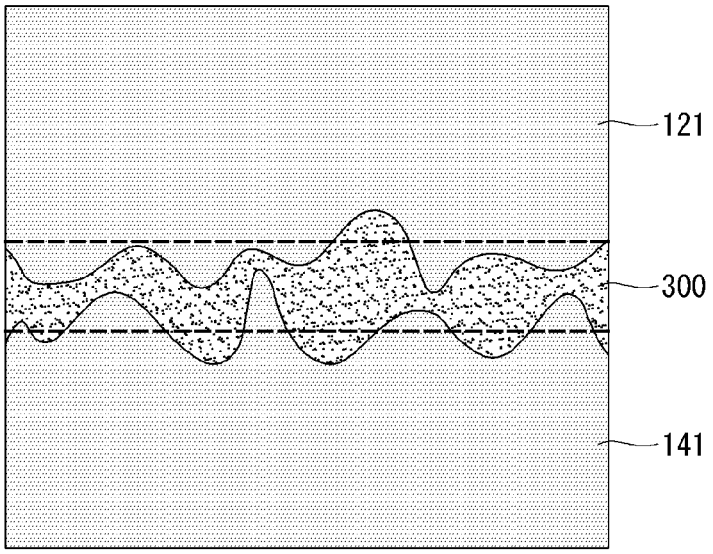
FIG. 9 schematically illustrates that a heat transfer member is disposed in a space between a cylinder and a second flange portion of a linear compressor according to an embodiment of the present disclosure.
Figure 10:
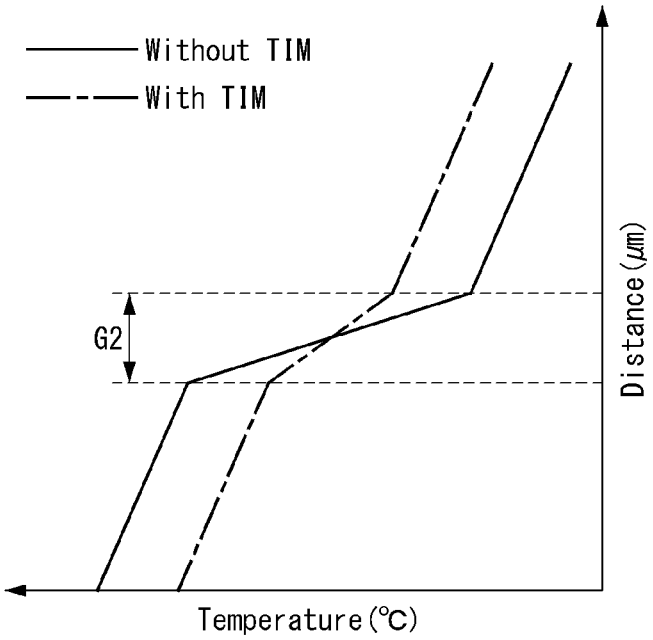
FIG. 10 is a graph illustrating changes in a temperature depending on a distance between a cylinder and a second flange portion in FIGS. 8 and 9.
Figure 11:
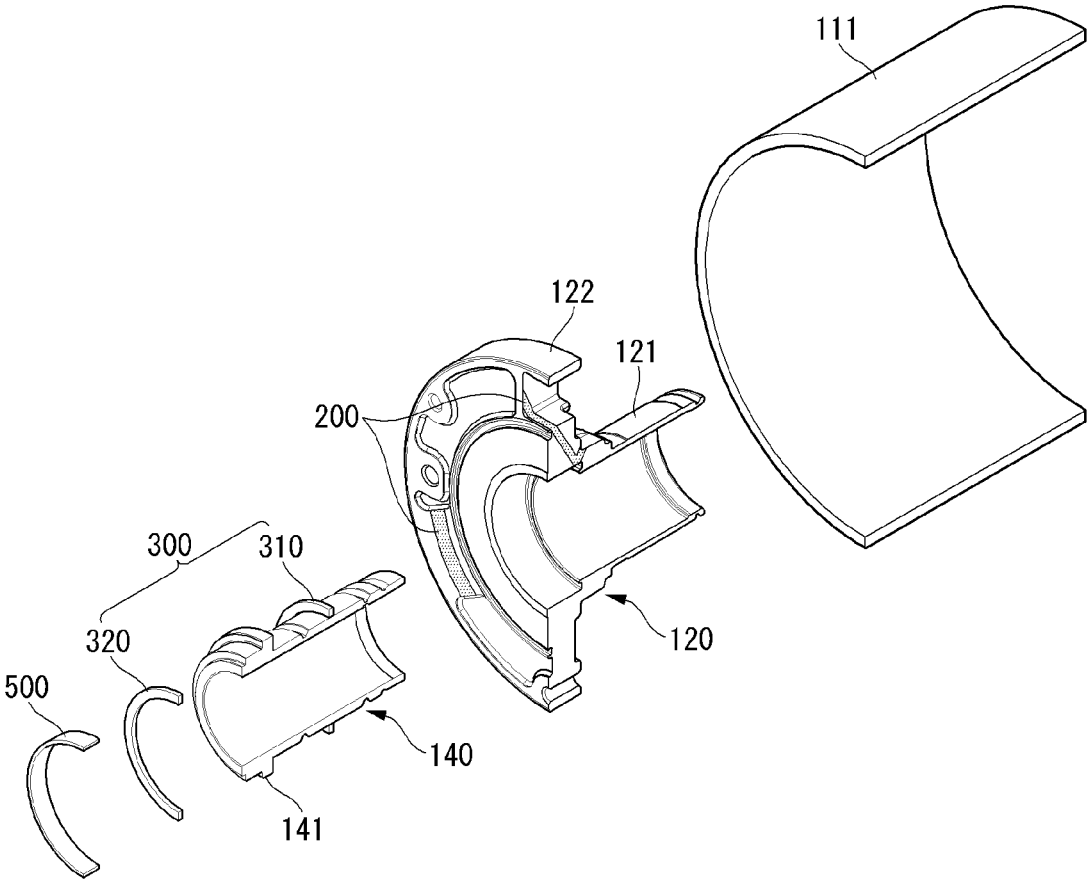
FIG. 11 is a cross-sectional perspective view of a partial configuration of a linear compressor according to an embodiment of the present disclosure.
Figure 12:
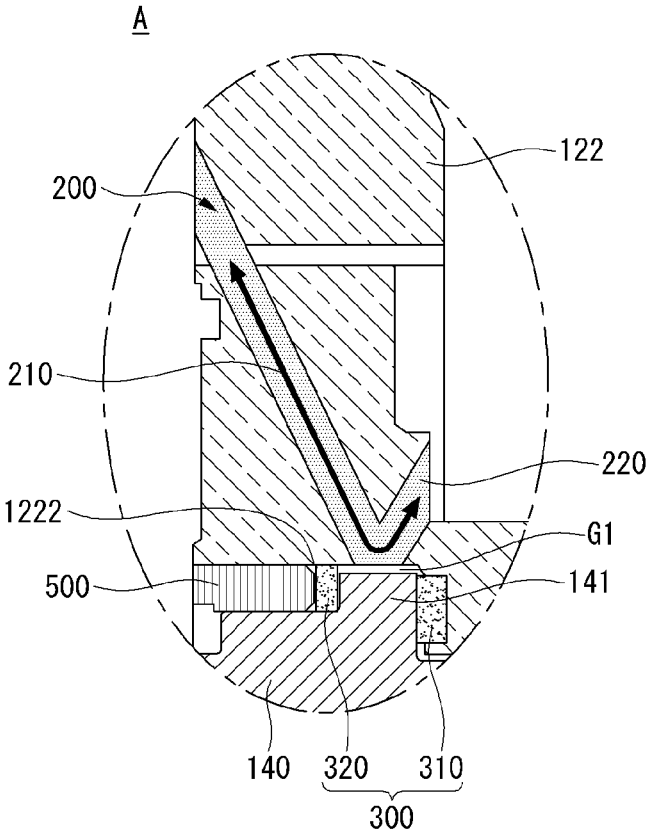
FIG. 12 is a cross-sectional view of a partial configuration of a linear compressor according to an embodiment of the present disclosure.
Figure 13:
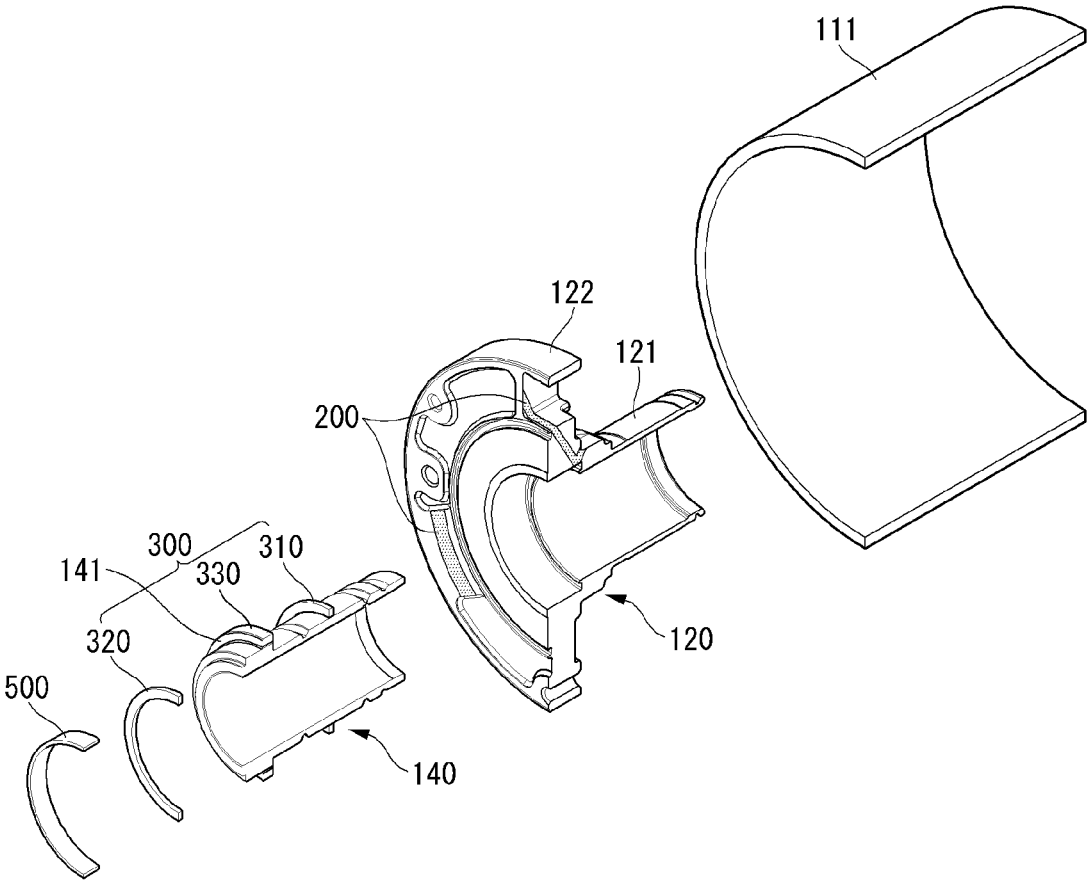
FIG. 13 is a cross-sectional perspective view of a partial configuration of a linear compressor according to an embodiment of the present disclosure.
Figure 14:
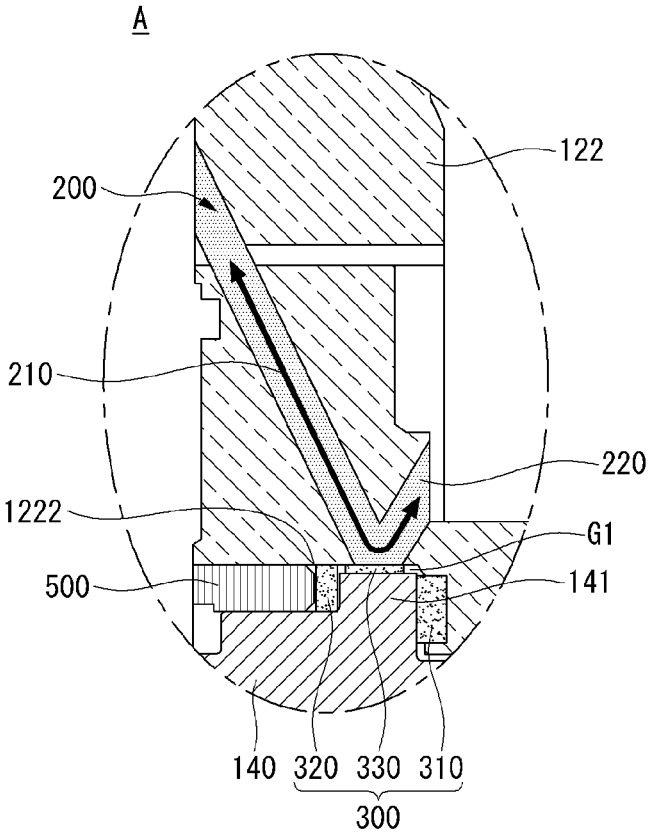
FIG. 14 is a cross-sectional view of a partial configuration of a linear compressor according to an embodiment of the present disclosure.
Figure 15:
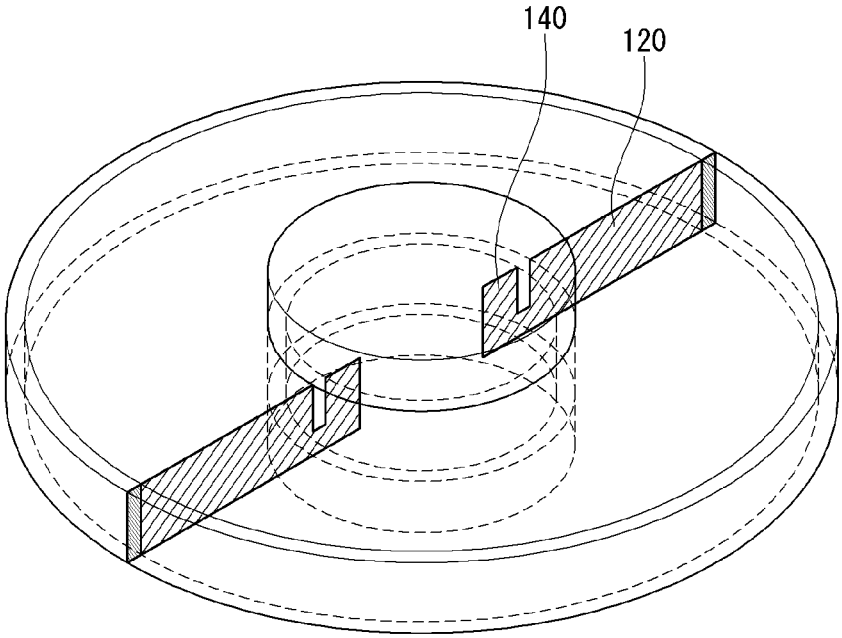
FIG. 15 schematically illustrates a temperature distribution of a cylinder and a frame of a linear compressor according to an embodiment of the present disclosure.

FIG. 3 is a cross-sectional exploded perspective view of a partial configuration of a linear compressor according to an embodiment of the present disclosure. FIG. 4 is a cross-sectional perspective view of a partial configuration of a linear compressor according to an embodiment of the present disclosure. FIG. 5 is a front view of a partial configuration of a linear compressor according to an embodiment of the present disclosure. FIG. 6 is a cross-sectional view of a linear compressor according to an embodiment of the present disclosure. FIG. 7 is a partial enlarged view of a portion 'A' of FIG. 6. FIG. 8 schematically illustrates a space between a cylinder and a second flange portion of a linear compressor according to an embodiment of the present disclosure. FIG. 9 schematically illustrates that a heat transfer member is disposed in a space between a cylinder and a second flange portion of a linear compressor according to an embodiment of the present disclosure. FIG. 10 is a graph illustrating changes in a temperature depending on a distance between a cylinder and a second flange portion in FIGS. 8 and 9. FIG. 11 is a cross-sectional perspective view of a partial configuration of a linear compressor according to an embodiment of the present disclosure. FIG. 12 is a cross-sectional view of a partial configuration of a linear compressor according to an embodiment of the present disclosure. FIG. 13 is a cross-sectional perspective view of a partial configuration of a linear compressor according to an embodiment of the present disclosure. FIG. 14 is a cross-sectional view of a partial configuration of a linear compressor according to an embodiment of the present disclosure. FIG. 15 schematically illustrates a temperature distribution of a cylinder and a frame of a linear compressor according to an embodiment of the present disclosure.

Referring to FIGS. 3 to 15, a linear compressor 100 according to an embodiment of the present disclosure may include a shell 111, a frame 120, a cylinder 140, a piston 150, a heat transfer member 300, and a fixing member 500. However, the linear compressor 100 may be implemented including more or less components according to an embodiment.

The shell 111 may be formed in a cylindrical shape. The frame 120 may be disposed in the shell 111.

The frame 120 may include a body portion 121 supporting an outer circumferential surface of the cylinder 140, and a first flange portion 122 extending radially from the front of the body portion 121. The frame 120 may be disposed in the shell 111. In an embodiment of the present disclosure, the radial direction (or radially) may mean a left-right direction based on FIG. 2.

The first flange portion 122 may include a hole 200. The hole 200 may pass through an axially front surface and a radially inner surface of the first flange portion 122 and pass through a radially inner surface and an axially rear surface of the first flange portion 122. The hole 200 may be formed in a 'V'-shape as a whole. In an embodiment of the present disclosure, it can be understood that the axially front surface means a left direction based on FIG. 6, and the axially rear surface means a right direction based on FIG. 6. In an embodiment of the present disclosure, it can be understood that the axial direction (or axially) means a vertical direction based on FIG. 2, an axially front means a downward direction based on FIG. 2, and an axially rear means an upward direction based on FIG. 2.

The hole 200 may communicate with an air layer G1 formed between the inner surface 122*c* of the first flange portion 122 and an outer surface of the cylinder 140. A separation space may be generated between the inner surface 122*c* of the first flange portion 122 and the outer surface of the cylinder 140 due to a tolerance of the product, and the air layer G1 may be formed in the separation space. In this case, since the air layer G1 provides a thermal insulation between the cylinder 140 and the first flange portion 122, heat in a front area of the cylinder 140 is not dissipated through the frame 120. However, because the hole 200 communicates with the air layer G1, heat in the front area of the cylinder 140 may be transferred to the frame 120 and may reduce a temperature of the cylinder 140. When the temperature of the cylinder 140 is reduced, a temperature of a suction refrigerant introduced into the cylinder 140 can be reduced, and thus the compression efficiency of the linear compressor 100 can be improved.

The hole 200 may include a first hole 210 penetrating the front surface 122*a* and the inner surface 122*c* of the first flange portion 122 and a second hole 220 penetrating the inner surface 122*c* and the rear surface 122*b* of the first flange portion 122. The first hole 210 may extend radially inward and axially rearward from the front surface 122*a* of the first flange portion 122 and penetrate the inner surface 122*c* of the first flange portion 122. The second hole 220 may extend radially outward and axially rearward from the inner surface 122*c* of the first flange portion 122 and penetrate the rear surface 122*b* of the first flange portion 122. The first hole 210 and the second hole 220 may be connected to each other. Hence, a heat transfer efficiency of transferring the heat of the front area of the cylinder 140 to the frame 120 can be improved.

A front end of the first hole 210 may be disposed radially outward further than a rear end of the second hole 220. A refrigerant in the front area of the frame 120 moves to the rear of the frame 120 through a space formed between the inner surface of the shell 111 and the outer surface of the first flange portion 122 of the frame 120. As the front end of the first hole 210 is disposed radially outward further than the rear end of the second hole 220, the present disclosure can smoothly flow the refrigerant and improve space efficiency.

The hole 200 may include a plurality of holes spaced apart in a circumferential direction. Specifically, referring to FIG. 5, the plurality of holes may be spaced apart from each other in the circumferential direction. Some of the plurality of holes may be formed between a plurality of coupling grooves 124 formed on the front surface of the first flange portion 122 in the circumferential direction, and other some of the plurality of holes may be formed between a coupling hole 126 penetrating the front surface and the rear surface of the first flange portion 122 in the circumferential direction and the coupling groove 124 formed in the front surface of the first flange portion 122. Hence, the present disclosure can avoid interference with other components while improving the space efficiency.

The first flange portion 122 may include a flange groove 1222 formed in the inner surface. A second flange portion 141 may be disposed in the flange groove 1222. The air layer G1 may be formed between a bottom surface 1222*a* of the flange groove 1222 and the second flange portion 141. The fixing member 500 may be disposed between the flange groove 1222 and the front end of the cylinder 140.

The cylinder 140 may be disposed in the frame 120. The cylinder 140 may be fixed to the body portion 121. The front area of the cylinder 140 may be disposed on the first flange portion 122.

The cylinder 140 may include the second flange portion 141 extending radially outward from an axially front area of the cylinder 140. The second flange portion 141 may be disposed in the flange groove 1222 of the first flange portion 122. The air layer G1 may be formed between the outer surface of the second flange portion 141 and the bottom surface of the flange groove 1222.

The piston 150 may be disposed in the cylinder 140 and may reciprocate axially.

The heat transfer member 300 may be disposed between the frame 120 and the cylinder 140. Referring to FIGS. 3 to 9, the heat transfer member 300 may be disposed between a rear surface 141*b* of the second flange portion 141 and a surface 120*d* connecting the bottom surface 1222*a* of the flange groove 1222 and the inner surface of the frame 120. In this case, the fixing member 500 may be disposed between the bottom surface 1222*a* of the flange groove 1222 and the front area of the cylinder 140 and disposed in the front area of the second flange portion 141 to fix the cylinder 140 to the frame 120. In this instance, an elastic member 400 may be disposed between a rear surface of the fixing member 500 and a front surface of the second flange portion 141. The heat transfer member 300 may be formed in a ring shape. The heat transfer member 300 may be formed of a material with elasticity.

Referring to FIG. 8, an irregular-shaped air gap G2 may be formed between the front surface of the body portion 121 of the frame 120 and the rear surface of the second flange portion 141 of the cylinder 140 due to the tolerance of the product and an air gap formed on the surface, etc.

Referring to FIG. 9, the heat transfer member 300 of a liquid state is introduced into the air gap G2 and is cured to fill the irregular-shaped air gap G2. Hence, the air gap formed between the front surface of the body portion 121 of the frame 120 and the rear surface of the second flange portion 141 of the cylinder 140 can be removed.

Referring to FIG. 10, it can be seen that a temperature difference per distance when the heat transfer member 300 is not present (Without TIM) is less than a temperature difference per distance when the heat transfer member 300 is present (With TIM). That is, since the heat transfer member 300 is disposed at a position of the air gap G2, it means that heat transfer efficiency by conduction can be improved. Hence, the present disclosure can improve the heat dissipation effect of the cylinder 140 as heat transfer by conduction.

FIGS. 6 and 7 illustrate that the heat transfer member 300 does not completely fill a space between the rear surface 141*b* of the second flange portion 141 and the surface 120*d* connecting the bottom surface 1222*a* of the flange groove 1222 and the inner surface of the frame 120. However, the present disclosure does not exclude that the heat transfer member 300 completely fills the space between the rear surface 141*b* of the second flange portion 141 and the surface 120*d* connecting the bottom surface 1222*a* of the flange groove 1222 and the inner surface of the frame 120.

Referring to FIGS. 11 and 12, the heat transfer member 300 may include a first heat transfer member 310 and a second heat transfer member 320.

The first heat transfer member 310 may be disposed between the rear surface of the second flange portion 141 and the surface connecting the bottom surface of the flange groove 1222 and the inner surface of the frame 120. It may be understood that the first heat transfer member 310 is the same as the heat transfer member 300 described in FIGS. 3 to 9.

The second heat transfer member 320 may be disposed between the fixing member 500 and the front surface of the second flange portion 141. The second heat transfer member 320 may be formed in a ring shape. The second heat transfer member 320 may be formed of a material with elasticity. It may be understood that the second heat transfer member 320 replaces the elastic member 400 described in FIGS. 3 to 9. Hence, the conduction efficiency through the heat transfer member 300 can be improved.

The second heat transfer member 320 in a liquid state may be disposed and cured in a space between the fixing member 500 and the front surface of the second flange portion 141 to entirely fill a space between the fixing member 500 and the front surface of the second flange portion 141. In this case, conduction efficiency through the second heat transfer member 320 can be improved.

Referring to FIGS. 13 and 14, the heat transfer member 300 may include a first heat transfer member 310, a second heat transfer member 320, and a third heat transfer member 330.

The third heat transfer member 330 may be disposed between the bottom surface of the flange groove 1222 and the outer surface of the second flange portion 141. In this case, the hole 200 may communicate with the third heat transfer member 330. The third heat transfer member 330 may be formed of a material with elasticity. The third heat transfer member 330 in a liquid state may be disposed and cured between the bottom surface of the flange groove 1222 and the outer surface of the second flange portion 141 to entirely fill a space between the bottom surface of the flange groove 1222 and the outer surface of the second flange portion 141. In this case, conduction efficiency through the third heat transfer member 330 can be improved.

FIG. 14 illustrates that the third heat transfer member 330 does not entirely fill the space between the bottom surface of the flange groove 1222 and the outer surface of the second flange portion 141. However, the present disclosure does not exclude that the third heat transfer member 330 entirely fills the space between the bottom surface of the flange groove 1222 and the outer surface of the second flange portion 141.

Referring to FIG. 15, it can be seen that the heat of the cylinder 140 is effectively transferred to the frame 120 through the hole 200 and the heat transfer member 300, and thus the cylinder 140 and the frame 120 have a similar temperature distribution as a whole. That is, the compression efficiency of the linear compressor 100 can be improved by reducing the temperature of the cylinder 140 through the linear compressor 100 according to an embodiment of the present disclosure.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A linear compressor comprising:

a shell;

a frame disposed in the shell, the frame comprising a body and a first flange extending radially from the body, the first flange having first and second surfaces and extending axially between the first and second surfaces, and the first flange having an inner surface that defines an inner diameter of the first flange between the first and second surfaces;

a cylinder fixed to the body; and a piston disposed in the cylinder and configured to reciprocate axially with respect to the cylinder, wherein the first flange comprises at least one hole extending within the first flange, and wherein the hole comprises:

a first hole portion extending between the first surface and the inner surface of the first flange, and a second hole portion extending between the inner surface and the second surface of the first flange.

2. The linear compressor of claim 1, wherein the at least one hole is in fluid communication with an air layer defined between the inner surface of the first flange and an outer surface of the cylinder.

3. The linear compressor of claim 1, wherein the first hole portion and the second hole portion are connected to each other.

4. The linear compressor of claim 1, wherein the at least one hole is configured in a 'V'-shape with the first hole portion and the second hole portion corresponding to two straight lines of 'V' respectively.

5. The linear compressor of claim 1, wherein an end of the first hole portion that is open at the first surface of the first flange is disposed radially further out than an end of the second hole portion that is open at the second surface of the first flange.

6. The linear compressor of claim 1, wherein the at least one hole comprises a plurality of holes spaced apart at the first flange in a circumferential direction.

7. The linear compressor of claim 1, wherein the first flange comprises a plurality of coupling grooves defined at the first surface of the first flange, and wherein the at least one hole is defined between adjacent coupling grooves in a circumferential direction.

8. The linear compressor of claim 1, wherein the first flange comprises a coupling groove defined at the first surface of the first flange, and a coupling hole spaced apart from the coupling groove in a circumferential direction, and wherein the at least one hole is disposed between the coupling groove and the coupling hole in the circumferential direction.

9. The linear compressor of claim 1, wherein the cylinder comprises a second flange protruding radially outward from the cylinder, wherein the first flange comprises a flange groove defined at the inner surface of the first flange, and wherein the second flange is positioned at the flange groove of the first flange.

10. The linear compressor of claim 9, further comprising:

a first heat transfer member disposed between (i) a surface connecting a bottom surface of the flange groove of the first flange and an inner surface of the frame and (ii) a surface of the second flange.

11. The linear compressor of claim 10, wherein the first heat transfer member is disposed between (i) the surface connecting the bottom surface of the flange groove and the inner surface of the frame and (ii) the surface of the second flange by introducing the first heat transfer member in a liquid state and curing the introduced first heat transfer member between (i) the surface connecting the bottom surface of the flange groove and the inner surface of the frame and (ii) the surface of the second flange.

12. The linear compressor of claim 9, further comprising:

a fixing member disposed between the flange groove of the first flange and an axial end of the cylinder; and a second heat transfer member disposed between the fixing member and a surface of the second flange.

13. The linear compressor of claim 9, further comprising:

a third heat transfer member disposed between a bottom surface of the flange groove and an radially-outer surface of the second flange, wherein the at least one hole is in fluid communication with the third heat transfer member.

* * * * *